US007195244B1

(12) United States Patent
Feola

(10) Patent No.: US 7,195,244 B1
(45) Date of Patent: Mar. 27, 2007

(54) METHOD OF PLAYING A PAI-GOW-TYPE GAME

(75) Inventor: John Feola, Medford, MA (US)

(73) Assignee: New Vision Gaming & Development, Inc., North Reading, MA (US)

( * ) Notice: Subject to any disclaimer, the term of this patent is extended or adjusted under 35 U.S.C. 154(b) by 0 days.

(21) Appl. No.: 10/890,445

(22) Filed: Jul. 13, 2004

(51) Int. Cl.
*A63F 1/00* (2006.01)

(52) U.S. Cl. ..... 273/292; 273/274

(58) Field of Classification Search ..... 273/292, 273/274; 463/13
See application file for complete search history.

(56) References Cited

U.S. PATENT DOCUMENTS

| | | | | | |
|---|---|---|---|---|---|
| 5,294,128 | A * | 3/1994 | Marquez | 273/292 |
| 5,580,061 | A * | 12/1996 | Kong | 273/292 |
| 5,584,486 | A * | 12/1996 | Franklin | 273/292 |
| 5,664,781 | A * | 9/1997 | Feola | 273/292 |
| 5,810,354 | A * | 9/1998 | Banyai | 273/292 |
| 5,839,731 | A * | 11/1998 | Feola | 273/292 |
| 5,863,041 | A * | 1/1999 | Boylan et al. | 273/292 |
| 5,863,042 | A * | 1/1999 | Lo | 273/292 |
| 5,931,472 | A * | 8/1999 | Ko | 273/292 |
| 5,951,012 | A * | 9/1999 | Feola | 273/292 |
| 5,984,779 | A * | 11/1999 | Bridgeman et al. | 463/16 |
| 6,007,424 | A * | 12/1999 | Evers et al. | 463/13 |
| 6,070,876 | A * | 6/2000 | Ko | 273/293 |
| 6,135,453 | A * | 10/2000 | Srichayaporn | 273/292 |
| 6,155,568 | A * | 12/2000 | Franklin | 273/292 |
| 6,402,147 | B1 * | 6/2002 | Lo | 273/292 |
| 6,457,714 | B1 * | 10/2002 | Feola | 273/274 |
| 6,474,646 | B1 * | 11/2002 | Webb | 273/274 |
| 6,491,302 | B1 * | 12/2002 | Boylan et al. | 273/292 |
| 6,631,906 | B1 * | 10/2003 | Timpano | 273/292 |
| 6,702,289 | B1 * | 3/2004 | Feola | 273/274 |
| 6,719,291 | B1 * | 4/2004 | deKeller | 273/274 |
| 6,793,220 | B1 * | 9/2004 | Feola | 273/292 |
| 2002/0163129 | A1 * | 11/2002 | Webb | 273/292 |
| 2003/0094761 | A1 * | 5/2003 | Furuta et al. | 273/292 |
| 2003/0155713 | A1 * | 8/2003 | Jones et al. | 273/292 |

* cited by examiner

*Primary Examiner*—Eugene Kim
*Assistant Examiner*—Dolores R. Collins
(74) *Attorney, Agent, or Firm*—Altman & Martin; Steven K. Martin

(57) ABSTRACT

A pai gow-type game in which a player wagers on one or more of a group of player hands, and where the chances of winning are not enhanced by the skills of the player and no discretion in the arrangement of hands is vested in either the player or dealer. A number of player hands and one or more banker hands are dealt on a playing surface and players wager as to which player hand or hands will beat the banker hand or hands. Each of the banker and player hands is arranged into a high hand and a low hand where the high hand has a higher rank than the low hand. A player hand is a winning hand if the player high hand has a higher rank than the banker high hand and the player low hand has a higher rank than the banker low hand. A player hand is a losing hand if the player high hand has a rank that is equal to or lower than the banker high hand and the player low hand has a rank that is equal to or lower than the banker low hand. Players that wagered on a winning player hand are paid based on the amount of the wager. Wagers are collected from those players that wagered on a losing player hand. If a player hand is neither a winning nor losing hand, no wagers are collected or winnings paid.

8 Claims, 5 Drawing Sheets

METHOD OF PLAYING A PAI-GOW-TYPE GAME

CROSS-REFERENCES TO RELATED APPLICATIONS

Not Applicable

STATEMENT REGARDING FEDERALLY SPONSORED RESEARCH OR DEVELOPMENT

Not Applicable

REFERENCE TO A SEQUENCE LISTING, A TABLE, OR A COMPUTER PROGRAM LISTING COMPACT DISK APPENDIX

Not Applicable

BACKGROUND OF THE INVENTION

1. Field of the Invention

The present invention relates to games of chance, more specifically, to a game based on pai gow in which necessary knowledge of the game is minimized and skill is not a factor in playing.

2. Description of the Related Art

When a person enters a casino for the first time, she encounters a wide array of games upon which to wager, including such games as poker, baccarat, blackjack, and pai gow poker, and pai gow tiles. This newcomer also sees people who are intimately familiar with the environment and with the games of gambling. While watching these people, the newcomer may feel overwhelmed and intimidated. This intimidation can take the form of feelings of embarrassment at not knowing how to play the games or not being able to play as fast or well as others, and can manifest itself by not trying new games or even in not gambling at all.

Pai gow poker is played with a standard deck of 52 cards plus a joker. The dealer deals out seven hands of seven cards each. The first hand is placed in a player or banker position depending upon the result of a random number generator, such as dice or an electronic device. The remainder of the hands are placed in the remainder of the player and banker positions in a clockwise direction. The player then arranges her seven cards to make two hands: a two-card hand and a five-card hand, where the five-card hand must be ranked higher than the two-card hand. Rankings are based on basic poker rankings. Thus, the highest two-card hand is a pair of aces, and the highest five-card hand is five aces (the four aces and joker). After all players have arranged their hands, the banker turns his cards over and arranges them according to a fixed set of rules known as the "house way." The player's five-card hand is compared to the banker's five-card hand and the player's two-card hand is compared to the banker's two-card hand. If there is an exact match between the five-card or two-card hands, called a copy, the tie goes to the banker. If the player wins one five-card hand or two-card hand and loses the other, a "push" results and no money exchanges hands. If the player wins both the five-card and two-card hands, she is paid even money, less a commission of typically 5%. If the player loses both the five-card and two-card hands, she loses the money wagered.

Pai gow tiles is played with a set of 32 tiles. The dealer creates eight stacks of four tiles. The first stack is placed in a player or banker position depending upon the result of a dice roll. The remainder of the stacks are placed in the remainder of the player and banker positions in a clockwise direction. The player then arranges her four tiles into two pairs and places them face down with the higher-ranked pair placed horizontally and the lower-ranked pair placed vertically. Rankings are determined from a table of all possible combinations of two tiles. After all players have arranged their tiles, the banker arranges his tiles according to a fixed set of rules known as the "house way." The player's high pair is compared to the banker's high pair and the player's low pair is compared to the banker's pair. If there is an exact match between the high pair or low pair, called a copy, the tie goes to the banker. If the player wins one pair and loses the other pair, a "push" results and no money exchanges hands. If the player wins both pairs, she is paid even money, less a commission of typically 5%. If the player loses both pairs, she loses the money wagered.

However simple or complicated the pai gow games are, choices still need to be made by the player during the course of the game. For the player that is unsure of herself, this can be a cause of anxiety and intimidation, especially when playing along side people who are experienced in the game.

BRIEF SUMMARY OF THE INVENTION

It is an object of the present invention to provide a game that is suitable for use in gambling.

Another object is to provide a game suitable for use in gambling based on a game where the player can feel comfortable learning the game.

Yet another object is to provide a game suitable for use in gambling based on a game where no knowledge of the rules of the game is necessary to play the game.

A further object is to provide a game suitable for use in gambling based on a game where the player can acquire knowledge of the rules of the game as games are played.

The present invention provides a game based on pai gow where no knowledge of the rules of pai gow is necessary to play, that is, the chances of winning are not enhanced by the skills of the player because all hands are controlled by the rules, with no discretion left to the players or banker. The contents of each hand and how each hand is played are purely random based on the draw of the cards or tiles.

The present invention is a method of playing a pai gow-like game with at least one set of playing tokens, which can be cards or tiles, with the method comprising the steps of (a) dealing out the playing tokens, to each of a player hand and a banker hand; (b) prior to and during the dealing, at least one player sporadically wagering on the player hand; (c) arranging the playing tokens in the banker hand into a high hand and a low hand, the banker high hand having a rank that is higher than the banker low hand; (d) arranging the playing tokens in the player hand into a high hand and a low hand, the player high hand having a rank that is higher than the player low hand; (e) comparing the player high hand to the banker high hand; (f) comparing the player low hand to the banker low hand; (g) identifying the player hand as a winning hand if the player high hand has a higher rank than the banker high hand and the player low hand has a higher rank than the banker low hand; and (h) identifying a winning wager as a wager placed on the winning hand.

Each player chooses the player hand or hands that, she thinks will beat the banker hand by placing a wager or wagers. The dealer deals out the hands, either a number of player hands and one banker hand for the first embodiment or equal numbers of player and banker hands for the second embodiment. For pai gow poker, seven cards are dealt to each hand and for pai gow tiles, four tiles are dealt to each hand. The banker arranges each of the banker and player hands in accordance with the house way. A player hand wins if player high and low hands have a higher rank than the banker high and low hands, respectively. The players choosing the winning player hands are paid based on their wagers.

Optionally, the game can be played with a player banking the game, rather than the gaming establishment. Optionally, side bets, set jackpots, and/or progressive jackpots may be played as an adjunct to the game of the present invention.

The present invention contemplates that the game may be played using other media, such as scratch or pull-tab tickets, video poker-type machines, personal computers, hand-held devices, slot machines, over an on-line computer network, or on another type of one-way or interactive gaming or entertainment equipment, such as keno-style or lottery-style equipment.

Other objects of the present invention will become apparent in light of the following drawings and detailed description of the invention.

BRIEF DESCRIPTION OF THE DRAWINGS

For a fuller understanding of the nature and object of the present invention, reference is made to the accompanying drawings, wherein.

DETAILED DESCRIPTION OF THE INVENTION

Figure 1:
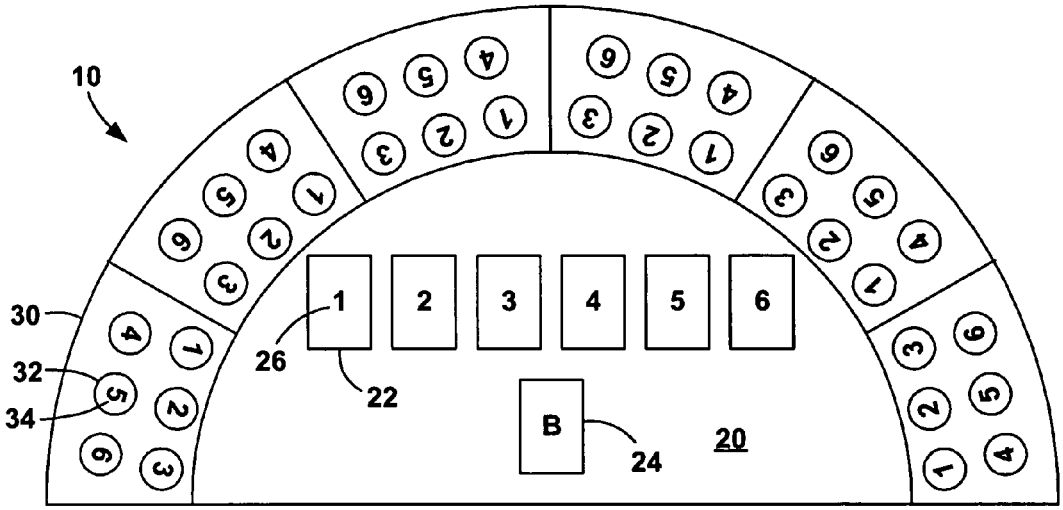
FIG. 1 shows a table layout of an embodiment of the basic game of the present invention with six player hands and one banker hand.

The present invention provides a game based on pai gow where no knowledge of the rules of pai gow is necessary to play. The game is played with a basic set of rules in two embodiments and includes a number of optional enhancements. The essence of the game is that a player wagers on one or more of a group of hands that she hopes will beat a banker hand. The chances of winning are not enhanced by the skills of the player because the rules of the game control all hands and neither the player nor the dealer has a say in the contents of each hand, how each hand is played, and, consequently, the outcome of the game. The contents of each hand are purely random based on the draw of the playing cards or tiles. Because a player can wager on any hand and has no control over the arrangement of each hand, it is irrelevant to each player how the other players are playing the game, for example, which hands they are wagering on and how much they are wagering.

As currently played in the typical casino, pai gow poker is played with a 53-card deck, which includes the standard 52 cards and a joker. The present invention contemplates that more than one deck and/or more than one joker or other wild cards may be used. Standard poker rankings determine winning hands. The ace is always the high card except when in an A-2-3-4-5 straight. In most gaming establishments, the A-2-3-4-5 straight is the second highest straight behind the 10-J-Q-K-A straight. The joker can only complete a flush, a straight, or a straight flush, otherwise it is treated as an ace. Optionally, rather than being limited to the values described above, the joker can assume a value according to a different set of rules.

As currently played in the typical casino, pai gow tiles is played with a 32-tile set. The ranking of hands is very involved and can be found in any text describing the rules of pai gow tiles. Optionally, the tile set can include a "wild tile" similar in function to the joker of pai gow poker, either by replacing a regular pai gow tile or by adding the wild tile to the 32-tile set.

The term "playing token" is used in the present application to indicate a playing card, a playing tile, or any facsimile thereof. For example, a playing token can be a paper playing card, a physical playing tile, an image of a card or tile on a video display, an image of a card or tile on a scratch ticket, etc. Any representation of a playing card or tile is contemplated. A "set of playing tokens" refers to one or more complete decks of playing cards or a set of 32 pai gow tiles. A "hand" is the group of playing tokens for a single position. When using playing cards, a hand consists of the seven cards placed at each player and banker position. When using tiles, a hand consists of the four tiles placed at each player and banker position.

Before game play begins, the house selects the rules of the game to be played, which includes such items as the house way, how many hands are dealt, and how the winning hand is determined. The number of hands dealt is not related in any way to the number of players, so it does not matter how many players there are in the game. There may be from two hands (one player hand and the banker hand) up to the maximum number of hands that can be made from the number of playing tokens available.

Figure 2:
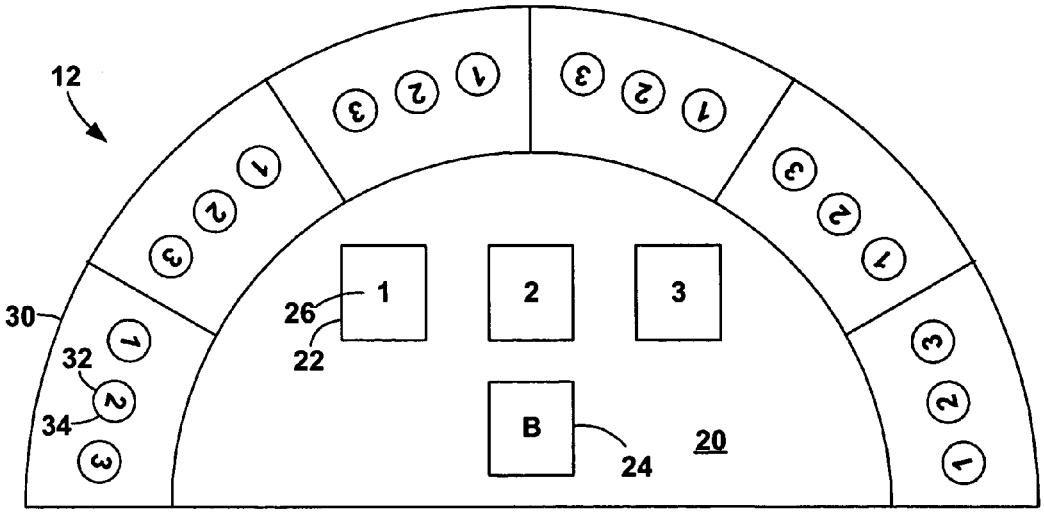
FIG. 2 shows a table layout of another embodiment of the basic game of the present invention with three player hands and one banker hand.
Figure 3:
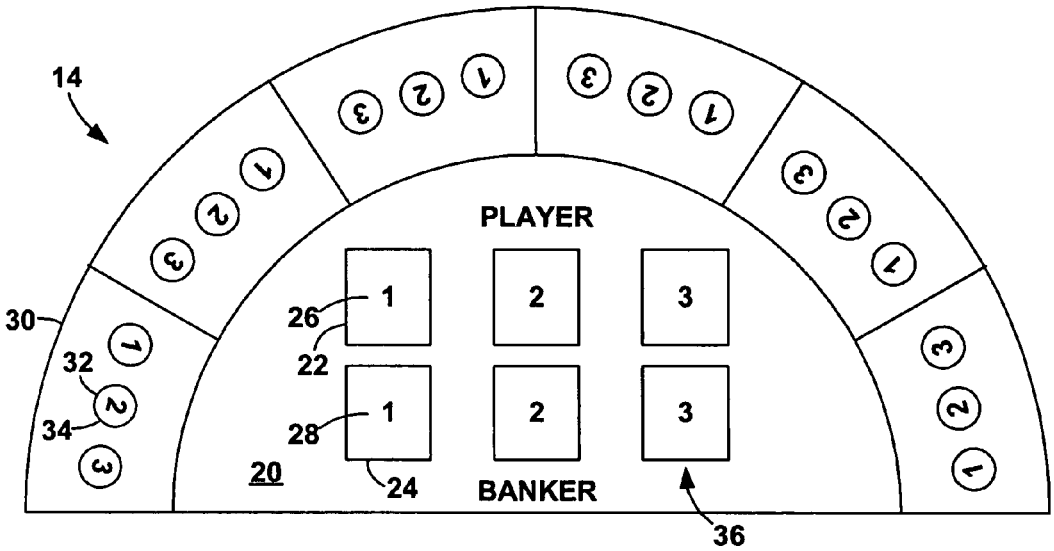
FIG. 3 shows a table layout of another embodiment of the basic game of the present invention with three player hands and three banker hands.

The game is played on a playing surface, typically a tabletop, although other playing surfaces are contemplated, as described below. Example configurations of playing surfaces 10, 12, 14 for the two embodiments of the present invention are shown in FIGS. 1–3. The playing surfaces 10, 12, 14 of FIGS. 1–3 are merely examples and any other playing surface configuration that provides the functionality needed to play the game of the present invention is contemplated.

The central dealer position 20 has a plurality of player hand locations 22, one for each player hand to be dealt. In the embodiment of FIGS. 1 and 2, the dealer position 20 has a banker hand location 24 for the one banker hand. In the embodiment of FIG. 3, the dealer position 20 has a banker hand location 24 for each of the player hand locations 22. The symbols 26 at each player hand location 22 are the player hand identifiers, which are typically numerals running sequentially from "1". The banker hand locations 24 of the embodiment of FIG. 3 have identifiers 28 that correspond to the adjacent player hand location 22.

There are a number of player positions 30. Typically, the player positions 30 are evenly spaced in a semicircle around the dealer position 20. Each player position 30 includes a symbol 32 containing a player hand identifier 34 corresponding to each player hand location 22. Typically, there are six player positions 30, but because the number of players is not related to the number of player hands, the number of player positions 30 may vary.

To begin the game, each player chooses the player hand or hands that she thinks will beat the banker hand. The selections are made by placing the amount to be wagered on the corresponding player hand identifier symbol 32 of the player position 30. The wagered amount is indicated by any marker or markers that acceptably signify value, such as cash, chips, or credit vouchers.

During or after the wagers are placed, the dealer deals out the predetermined number of hands. For the embodiment of FIG. 1, the dealer deals out six player hands and a banker hand, placing them in the appropriate locations 22, 24 of the dealer position 20. For the embodiment of FIG. 2, the dealer deals out three player hands and a banker hand, placing them in the appropriate locations 22, 24 of the dealer position 20. For the embodiment of FIG. 3, the dealer deals out three player hands and three corresponding banker hands, placing them in the appropriate locations 22, 24 of the dealer position 20. Optionally, for the embodiment of FIG. 3, separate sets of playing tokens are used for each hand pair 36 composed of one player hand 22 and the corresponding banker hand 24.

Each hand is dealt the appropriate number of playing tokens. For pai gow poker, seven cards are dealt and for pai gow tiles, four tiles are dealt. The rules determine whether the playing tokens are dealt face up or face down. Because there is no discretion in the way the hands are played, the method chosen does not affect the result of the game, and may be chosen more for the suspense factor than any other.

The banker arranges each of the hands in accordance with the house way. In the embodiment of FIGS. 1 and 2, the banker hand typically will be arranged before arranging the player hands. Optionally, the player hands will be arranged before the banker hand. In the embodiment of FIG. 3, the banker hand typically will be arranged immediately before the corresponding player hand. Optionally, the player hand will be arranged before the corresponding banker hand. Since there is no discretion in how the hands are arranged, the order in which the hands are arranged does not affect the outcome. In pai gow poker, the hands are arranged into a five-card hand and a two-card hand. In pai gow tiles, the hands are arranged into two, two-tile groups, with one being designated the high group and the other being the low group. In the present application, the five-card hand and the high group are collectively referred to as the high hand, and the two-card hand and the low group are collectively referred to as the low hand.

In a casino, the house way is how the dealer hand is arranged. The house way differs from casino to casino, but the differences in the results are generally marginal. An example of a house way for pai gow poker is described below, listed by what ranking the seven cards have:

1. No pair: Place the highest card in the high hand and the next two highest cards in the low hand.

2. One pair: Place the pair in the high hand and the next two highest cards in the low hand.

3. Two pair: Use the following groups to determine how to play a two pair: 2 through 6 are low pairs, 7 through 10 are medium pairs, and J through K are high pairs: (1) low pair and low pair: split unless holding a king or better, then play two pair in the high hand; (2) low pair and medium pair: split unless holding a king or better, then play two pair in the high hand; (3) low pair and high pair: split unless holding an ace, then play two pair in the high hand; (4) medium pair and medium pair: split unless holding an ace, then play two pair in the high hand; (5) medium pair and high pair: always split; (6) high pair and high pair: always split; and (7) pair of aces and any other pair: always split.

4. Three pair: Always play the highest pair in the low hand.

5. Three of a kind: Always play three of a kind in the high hand unless they are aces, then play a pair of aces in the high hand and one ace in the low hand.

6. Three of a kind twice: Always play the highest pair in the low hand.

7. Straights, flushes, straight flushes, and royal flush: (1) with no pair: when choosing whether to play a straight, flush, or straight flush play the category which will allow the highest two cards in low hand; (2) with a 6th or 7th card: play the lower straight or flush in the high hand to place the highest cards in the low hand; (3) with one pair: play the pair in the low hand only if a straight, flush, or straight can be played in the high hand; (4) with two pair: use the two pair rule; (5) with three pair: use the three pair rule; (6) with three of a kind: play a pair in the low hand; and (7) with a full house: use the full house rule.

8. Full house: always split unless the pair is twos and you have an ace and a king to play in the low hand.

9. Full house with three of a kind and two pairs: play the highest pair in the low hand.

10. Full house with three of a kind twice: Always play the highest pair in the low hand.

11. Four of a kind: play according to the rank of the four of a kind: (1) 2 through 6: always keep them together; (2) 7 through 10: split unless a king or better can be played in the low hand; (3) J through K: split unless an ace can be played in the low hand; and (4) aces: always split.

12. Four of a kind and a pair: Play the pair in the low hand.

13. Four of a kind and three of a kind: Play a pair in the low hand from the three of a kind.

14. Five aces: play three aces in the high hand and two aces in the low hand unless you have a pair of kings, then play five aces in the high hand and the kings in the low hand.

An example of a house way for pai gow tiles is described below:

1. Always keep pairs together except: (1) split a supreme pair with a 6-4, 6-5, or 6-6; (2) split 2s or 12s to make a 6-8 or better and also split with a 9 and 11; (3) split 9s with any two of 2, 10, and 12; (4) split 8s with any two of 2, 10, 11, and 12, and also split with a 9 and 11; and (5) split 7s with any two of 2, 10, 11, and 12.

2. Play a 2 or 12 with a 7, 8, or 9. With both a 2 and 12, play the 12 in the high hand. Play a high 9 over wong and gong and gong over wong except: (1) Play wong over gong when the fourth tile is 11; (2) play wong over a high 9 when the fourth tile is 11; and (3) play gong over a high 9 when the fourth tile is any 4 or when the third and fourth tiles are low (mixed) 8 and 5.

3. Make the low hand as high as possible. This includes playing the high tile in the low hand when given the choice. Exceptions: (1) If the low hand does not have a value of at least a long 3 (a total of 3 with the long tile or higher) and a 7 or higher is possible in the high hand, make the high hand as high as possible. This includes playing the high tile in the high hand when given the choice. (2) If the two hands total 8-9 or more, play the high tile in the high hand. (3) With a 2, 5, 6, and 12, play 7, high 8. (4) With a high 8, low 8, high 4, and any 7: play 2, high 5. (5) With a high 10, low 10, high 6, and any 7: play 6, high 7. (6) With a high 10, low 10, high 6, and low 8: play 6, high 8. (7) With a high 10, low 10, high 6, and any 9: play 6, high 9. (8) With a high 10, high 8, 11, and low 7: play 7, high 9. (9) With a high 4, low 4, gee (mixed 6), and 5: play high 7, 9. (10) With a 2 or 12, any 6, 5, and gee: play 7, 9. (11) With a high 6, low 6, 11, and gee: play 7, high 9. (12) With a high 8, low 8, any 7, and 9: play high 5, 7.

A winning player hand is determined by comparing the player high and low hands to the banker high and low hands, respectively, using the selected rules. For the embodiment of FIGS. 1 and 2, all player hands are compared to the one banker hand. For the embodiment of FIG. 3, each player hand is compared to the corresponding banker hand. The player high hand is compared to the banker high hand and the player low hand is compared to the banker low hand. If there is an exact match between high hands or low hands, called a copy, the tie goes to the banker hand. If the player hand wins the high hand or low hand and loses the other, a "push" results and no money exchanges hands. If the player hand wins both the high and low hands, it is a winning player hand. If the player hand loses both the high and low hands, it is a losing player hand.

The players choosing the winning player hands receive a predetermined amount of winnings that is typically equal to the amount that the player wagered on the player hand, that is, the winning multiple is 1. optionally, the banker collects a commission, typically 5%, on all player winnings. The banker collects all losing wagers. If there is a push, no winnings are distributed and no wagers are collected.

There are a number of other optional enhancements to the basic game. In one option, the game can be played where one of the players, rather than the gaming establishment, is the banker. The player may pay for the privilege of being the banker or the privilege may rotate among those players that wish to exercise the privilege. The establishment may require that the banker player pay a fee to the establishment for the privilege. To cover the costs to the establishment of furnishing the playing facilities, the establishment may collect a percentage of the wagers for each hand, a fixed amount for each game, or a fixed amount for increments of time, such as an hour. Optionally, when one of the players is the banker, the banker hand can be arranged as desired by the banker, rather than according to the house way.

Optionally, side bets and/or jackpots may be played as an adjunct to the game of the present invention. Those players that do not choose to play a side bet or jackpot may still play the game. It is optional with the house whether or not to allow a side bet or jackpot to be played without also playing the game. Only those players who wager a predetermined amount on a jackpot before a game are eligible to win that jackpot on the completion of that game.

A jackpot may be "set" or "progressive". In a set jackpot, the amount put into the jackpot for each game is fixed, but the fixed amount may be adjusted periodically, for example, after the jackpot is won. If more than one eligible player wins a set jackpot, each winner is paid a predetermined amount. In a progressive jackpot, the amount put into the jackpot increases for each game played during which the jackpot is not won. If more than one eligible player wins a progressive jackpot, its value is divided equally among the winners.

One possible form of a side bet or jackpot allows a player to wager that a hand, either the banker hand or a player hand, will have a particular combination of playing tokens. The side bet is won when the particular combination of playing tokens is dealt to the hand. Another side bet or jackpot allows a player to wager that two or more hands will have the same rank.

Optionally, the jackpots from more than one table may be linked together as a single jackpot.

The present invention contemplates that, rather than being played on a table surface with a live dealer, the game is played using other media, such as scratch or pull-tab tickets, video poker-type machines, personal computers, hand-held devices, slot machines, over an on-line computer network, or on another type of one-way or interactive gaming or entertainment equipment, such as keno-style or lottery-style equipment.

Figure 4:
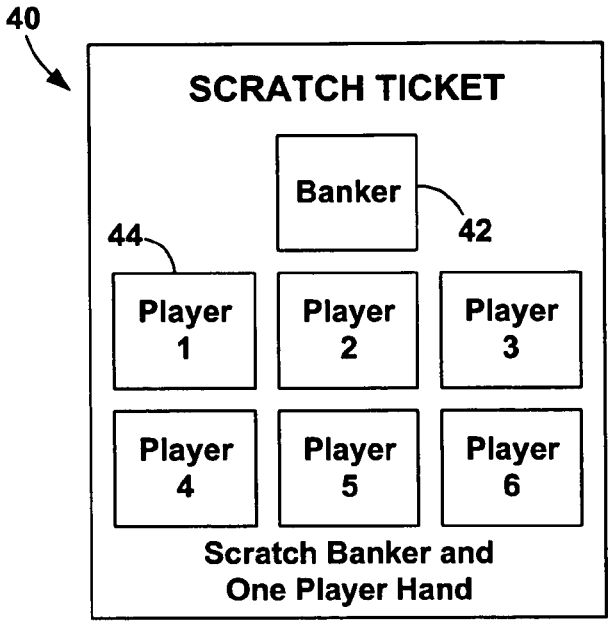
FIG. 4 shows a scratch ticket implementing the basic game of the present invention.

In one example of a scratch ticket 40, shown in FIG. 4, there is a scratch location 42 for the banker hand and a plurality of scratch locations 44 for the player hands. The playing tokens for each hand are randomly selected prior to printing. The player scratches to reveal the banker hand 42 and one of the player hands 44. If the revealed player hand 44 beats the banker hand 42, the ticket 40 is a winning ticket.

Figure 5:
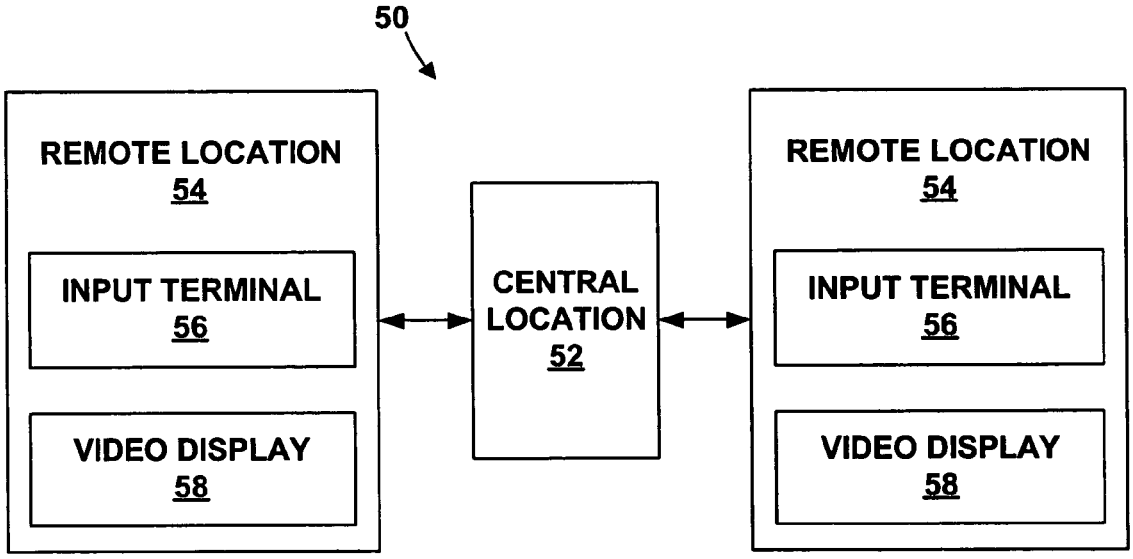
FIG. 5 shows a block diagram of a keno-style system implementing the basic game of the present invention.

In a keno-style lottery system 50, a block diagram of which is shown in FIG. 5, a player typically makes her choice of player hands at a remote location 54 by marking a slip of paper with the hands she wishes to wager on and the wager amount. She gives the slip to a clerk with the amount of the wager in cash, who then scans the slip into a terminal 56 that sends the choices to a central location 52. Alternatively, choices can be made from keys on a keyboard, keys on a key grid, or by boxes on a touch screen grid. Alternatively, the player many request a "quick pick," where the input terminal 56 or central location 52 randomly chooses a hand or hands for the player. The player receives a receipt, such as a paper receipt, or other acknowledgement, such as an indication on a private terminal, indicating the hand or hands chosen for the game. As the game is being played, the hands are displayed on a video screen 58 or matrix of video screens visible to the players at the remote location 54 from information received from the central location 52.

Figure 6:
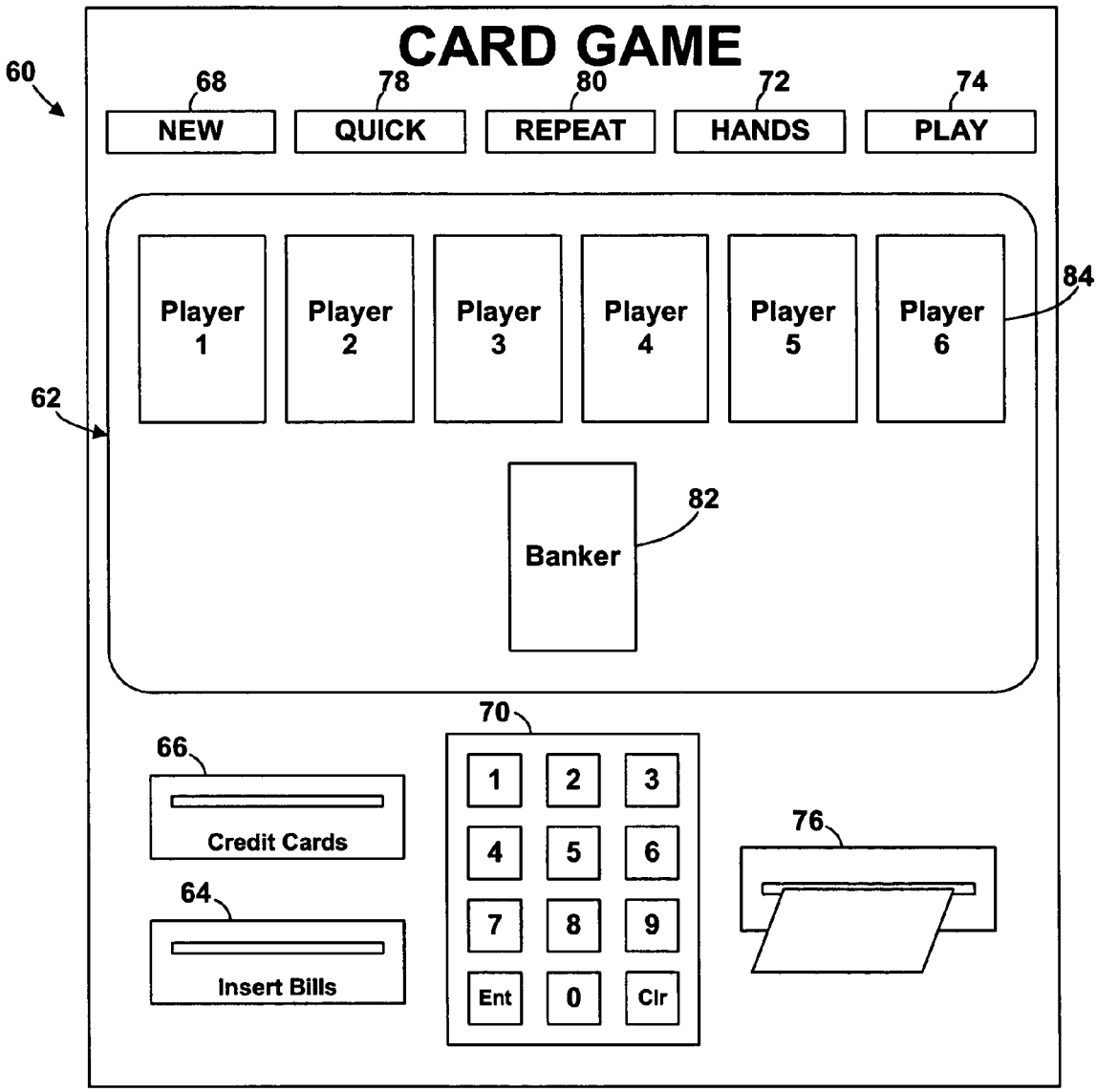
FIG. 6 shows a video screen implementing the game shown in FIG. 1.
Figure 7:
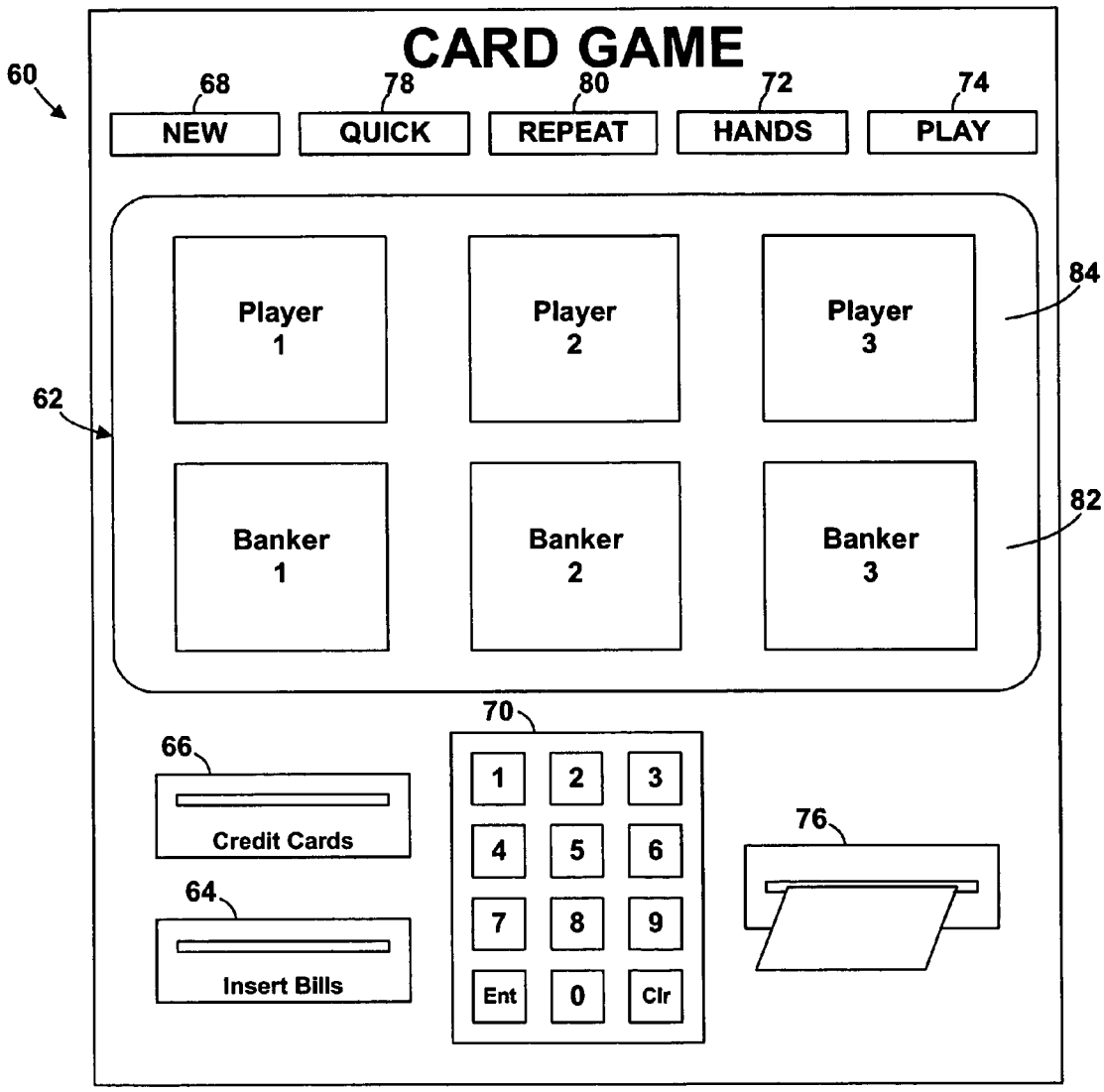
FIG. 7 shows a video screen implementing the game shown in FIG. 3.

With individual machines, examples of which are shown in FIGS. 6 and 7, implementing the embodiments of FIGS. 1 and 3, respectively, each player has her own terminal 60. An example is a video machine at a gaming establishment. The banker hands 82 and player hands 84 are displayed on the player's video screen 62. Prior to playing a game, the player inserts cash, a voucher, or a paper ticket, into a money reader 64 or swipes a credit card, debit card, or player card in a card reader 66. The player presses the NEW button 68 and indicates the amount to wager for the game, typically by entering an amount on the keypad 70. The player begins a game by pressing the HANDS button 72 and entering the player hands on which the player wishes to wager using the keypad 70 or a touch screen 62. The player presses the PLAY button 74 to deal the playing tokens and arrange the hands. Winning amounts are credited to the player and may be printed on a voucher 76 for payment by a cashier or they may be paid in coins or other monetary tokens by the terminal itself. Optionally, the terminal 60 may include a QUICK button 78 to provide the player with a "quick pick" option, and/or a REPEAT button 80 so that the player may repeat the hand choices from the previous game.

Alternatively, the standalone machine may be a personal computer, hand-held device, or mobile telephone. The standalone machine can be part of a wired or wireless network. Wagers can be made by debits to credit cards, debit cards, or other cash equivalent. Payouts can be made by crediting credit cards, debit cards, or other bank account, by dispatching gifts, or by any other method wherein the player is credited with the amount won.

Thus, it has been shown and described a pai gow-type game that satisfies the objects set forth above.

Since certain changes may be made in the present disclosure without departing from the scope of the present invention, it is intended that all matter described in the foregoing specification and shown in the accompanying drawings be interpreted as illustrative and not in a limiting sense.

I claim:

1. A method of playing a pai gow-like game with at least one set of playing tokens, said method comprising the steps of:

(a) determining a house way for arrangement of a hand of said playing tokens, said house way leaving no discretion in said arrangement, said house way including arranging said hand into a high hand and a low hand wherein said high hand has a rank that is higher than said low hand;

(b) dealing out said playing tokens to a plurality of player hands and a respective banker hand for each of said player hands, a hand pair being comprised of one of said player hands and said respective banker hand, each hand pair being dealt from a separate set of playing tokens;

(c) prior to and during said dealing, at least one player wagering on one or more of said player hands;

(d) arranging said playing tokens in each of said banker hands into a banker high hand and a banker low hand according to said house way;

(e) arranging said playing tokens in each of said player hands into a player high hand and a player low hand according to said house way;

(f) comparing said player high hand to said banker high hand of said respective banker hand;

(g) comparing said player low hand to said banker low hand of said respective banker hand;

(h) identifying each of said player hands as a winning hand if said player high hand has a higher rank than said banker high hand of said respective banker hand and said player low hand has a higher rank than said banker low hand of said respective banker hand;

(i) identifying a winning wager as a wager placed on said winning hand; and (j) paying winnings to said player if said player wagered on said winning hand.

2. The method of playing a game of claim 1 wherein said set of playing tokens is at least one deck of playing cards.

3. The method of playing a game of claim 2 wherein seven cards are dealt to said each of said player hands and each of said banker hands, said player high hand has five cards, said player low hand has two cards, said banker high hand has five cards, and said banker low hand has two cards.

4. The method of playing a game of claim 1 wherein four tokens are dealt to each of said player hands and each of said banker hands, said player high hand has two tokens, said player low hand has two tokens, said banker high hand has two tokens, and said banker low hand has two tokens.

5. The method of playing a game of claim 1 wherein said game is implemented on a keno-type lottery system.

6. The method of playing a game of claim 1 wherein said game is implemented on a video poker-type system.

7. The method of playing a game of claim 1 wherein a jackpot is provided, at least one jackpot player is permitted to wager on said jackpot, said at least one jackpot player wagering on said jackpot winning a predetermined portion of said jackpot if a predetermined combination of said tokens is dealt.

8. The method of playing a game of claim 7 wherein said jackpot is progressive.

* * * * *